US005405149A

United States Patent [19]

Allen

[11] Patent Number: 5,405,149

[45] Date of Patent: Apr. 11, 1995

[54] APPARATUS FOR HITTING AN OBJECT

[75] Inventor: Tobie L. Allen, Fruitport, Mich.

[73] Assignee: Earl Bentley, Irving, Tex.

[21] Appl. No.: 92,125

[22] Filed: Jul. 15, 1993

[51] Int. Cl.[6] ..... A63B 67/20

[52] U.S. Cl. ..... 273/330

[58] Field of Search ..... 273/330, 329, 319, 333, 273/334, 335, 413, 414, 67 R, 85 G

[56] References Cited

U.S. PATENT DOCUMENTS

| | | | |
|---|---|---|---|
| 1,184,863 | 5/1916 | Miller | 273/67 R |
| 2,250,802 | 7/1941 | Johnston | 273/330 |
| 4,222,563 | 9/1980 | Heftler et al. | 273/67 R |
| 4,281,833 | 8/1981 | Sandler et al. | 273/85 G |
| 5,190,491 | 3/1993 | Connelly | 273/67 R X |
| 5,249,810 | 10/1993 | Cazalet | 273/330 |

*Primary Examiner*—William H. Grieb
*Attorney, Agent, or Firm*—W. Thomas Timmons; Timmons & Kelly

[57] ABSTRACT

A paddle, including a surface for hitting a ball or other object, a transducer coupled to the hitting surface for detecting when the hitting surface hits the object, a counter for counting the number of hits and a display is disclosed. In one arrangement, the counter is a processor from a microcontroller. A timer is coupled to the transducer and to the counter for determining the time elapsed from the last hit. The timer stops the counter when the time elapsed since the most recent hit exceeds a predetermined length of time, indicating a miss of the ball. An audio amplifier drives a speaker so that the speaker makes a first predetermined sound whenever the hitting surface hits the object. The speaker emits a second predetermined sound when there is a miss, as indicated by the timer. A manual reset is coupled to the processor. A push button resets the counter to zero. A source of electric power, such as batteries, is located inside the handle. Light emitting diodes are affixed to the body near the periphery of the hitting surface to flash in decorative patterns, but can be coordinated to display when a hit is made or when a miss is detected or when some other game event occurs. In general, an apparatus for hitting an object includes a surface for hitting the object, a counter, a transducer coupled to the hitting surface and to the counter, for indicating to the counter when the hitting surface hits the object, and a display coupled to the counter for indicating the number of hits.

16 Claims, 5 Drawing Sheets

APPARATUS FOR HITTING AN OBJECT

BACKGROUND OF THE INVENTION

1. Field of the Invention

The present invention relates generally to methods and apparatus for detecting and recording the hitting of an object and, in one of its aspects, to games and equipment for playing paddle games.

2. Description of Related Art

A toy constructed of a wooden paddle and a rubber ball connected by a long elastic cord has entertained generations of children in addition to providing them exercise and hand-eye coordination. In a modern version, the paddle is made of plastic and makes a popping sound when it hits the ball.

U.S. Pat. No. 5,190,491, (Connelly) shows a paddle with light emitting diodes on its face. The paddle body is swung in a circle about the handle. The light emitting diodes are illuminated selectively, by circuitry including either a walking ring counter or a binary counter, as the paddle is swung in order to present the appearance of different patterns. The paddle also makes a clicking sound as it is rotated about the handle. The clicking sound is made mechanically by a finger 28, which is fixed relatively to the handle, contacting projections 30 which move with the paddle body. In this respect, the device is similar to noise makers associated with Halloween carnivals and Purim.

A simulated racquet ball game is shown in U.S. Pat. No. 4,281,833, (Sandler et al.). The ball position is electronically simulated with stereo sound as is the hitting of the "ball" by a racquet.

SUMMARY OF THE INVENTION

In accordance with the present invention, a paddle for use by a player for hitting a ball or other object includes a handle for the player to manually hold the paddle and a body attached to handle, forming a neck between the body and the handle. A surface for hitting the object forms at least one face of the paddle. The body of the paddle in combination with the at least one hitting surface forms the blade of the paddle. A transducer is coupled to the hitting surface for detecting when the hitting surface hits the object.

A counter is coupled to the transducer for counting the number of times that the object is struck, and a display located on or adjacent to the neck of the paddle is coupled to the counter for indicating the number of hits. In a preferred arrangement, the counter is a processor from a microcontroller. In such an arrangement, a number of players can play, entering the number of players into the microcontroller.

In one arrangement, a timer is coupled to the transducer and to the counter for determining the time elapsed from when the hitting surface hits the object. The timer stops the counter when the time elapsed since the most recent hit exceeds a predetermined length of time. In the arrangement where there is a rubber ball attached to the paddle by a long elastic cord, the predetermined length of time would be one that would indicate a "miss" of the ball, no more than a few seconds. The timer, in the case where the counter is a processor from a microcontroller, would include the timer circuit of the microcontroller and a crystal.

An audio amplifier is coupled to the transducer, through the microcontroller or otherwise, and to a speaker so that the speaker makes a first predetermined sound whenever the hitting surface hits the object. The speaker emits a second predetermined sound when there is a miss, as indicated by the timer. In an arrangement with multiple players, the speaker emits a third predetermined sound when the number of players is entered or when the number of the current player is changed.

A manual reset is coupled to the processor. When the manual reset is activated by a player, the counter is reset to zero. For the paddle and ball arrangement, the manual reset is a normal push button located on or adjacent to the neck of the paddle and can be used for input of the number of players to the microcontroller. Either the start of a new game or a switch between players would reset the counter. Pressing the push button for a short, for example one second, period of time would change from one player to the next. Pressing it for a longer period of time, greater than two seconds for example, would start a new game.

A source of electric power, such as batteries, for operation of the processor, the display and the amplifier is located inside the handle.

Light emitting diodes are affixed to the body near the periphery of the hitting surface. They are controlled by the processor to flash in decorative patterns, but could be coordinated to display when a hit is made or when a miss is detected or when some other game event occurs.

In general, an apparatus for hitting an object includes a surface for hitting the object, a counter, a transducer coupled to the hitting surface and to the counter, for indicating to the counter when the hitting surface hits the object, and a display coupled to the counter for indicating the number of hits.

These and other objects, advantages and features of this invention will be apparent from the following description taken with reference to the accompanying drawing, wherein is shown a preferred embodiment of the invention.

DESCRIPTION OF THE PREFERRED EMBODIMENT

Figure 1:
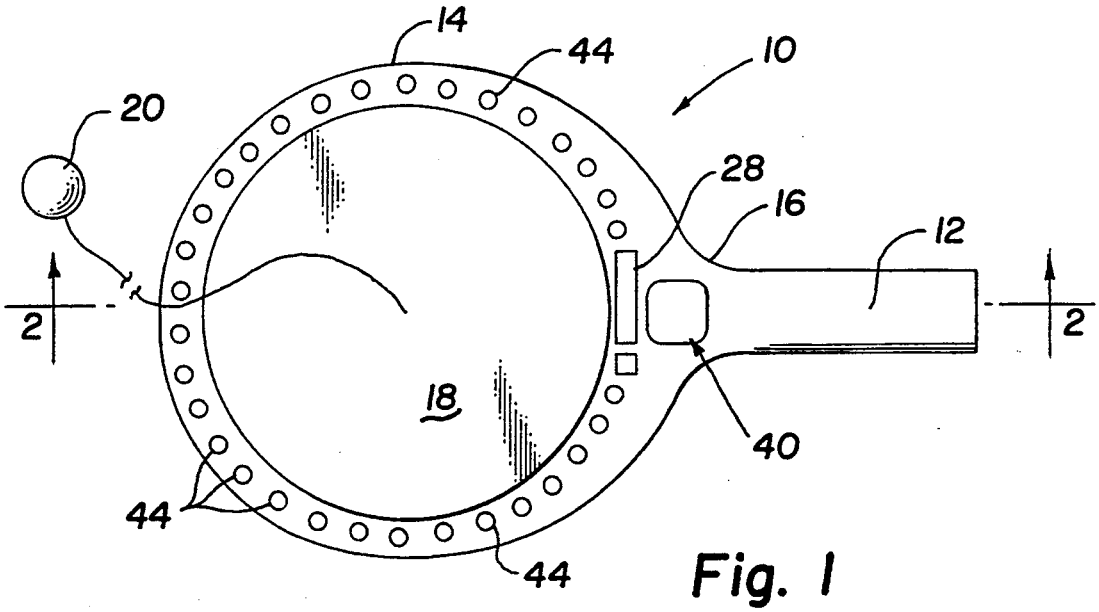
FIG. 1 is a front elevational view of a paddle according to the present invention with a ball attached by an elastic cord of indefinite length.
Figure 2:
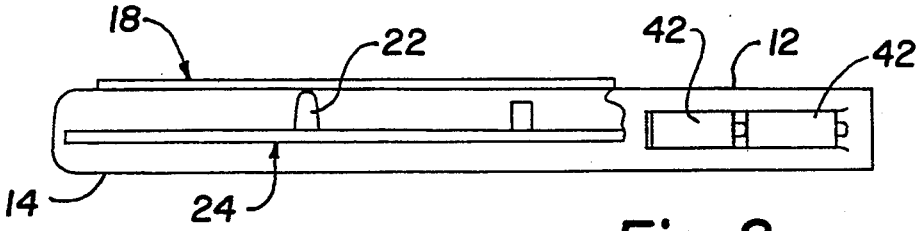
FIG. 2 is a sectional view thereof taken at 2—2 of FIG. 1.
Figure 3:
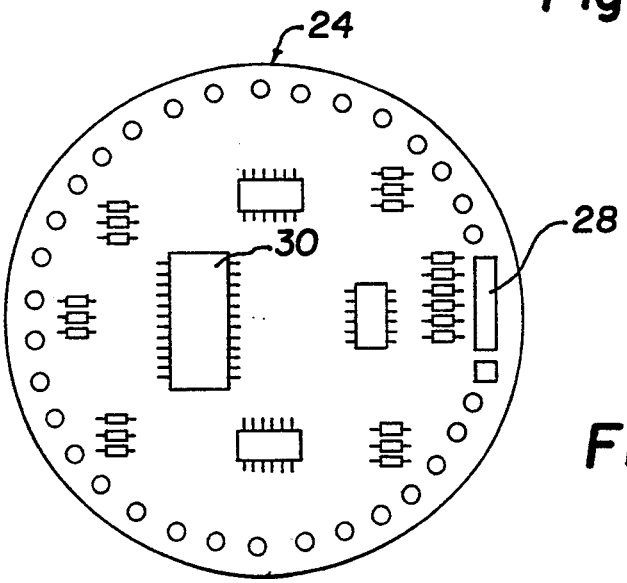
FIG. 3 is a front elevational view of a printed circuit board thereof.
Figure 4:
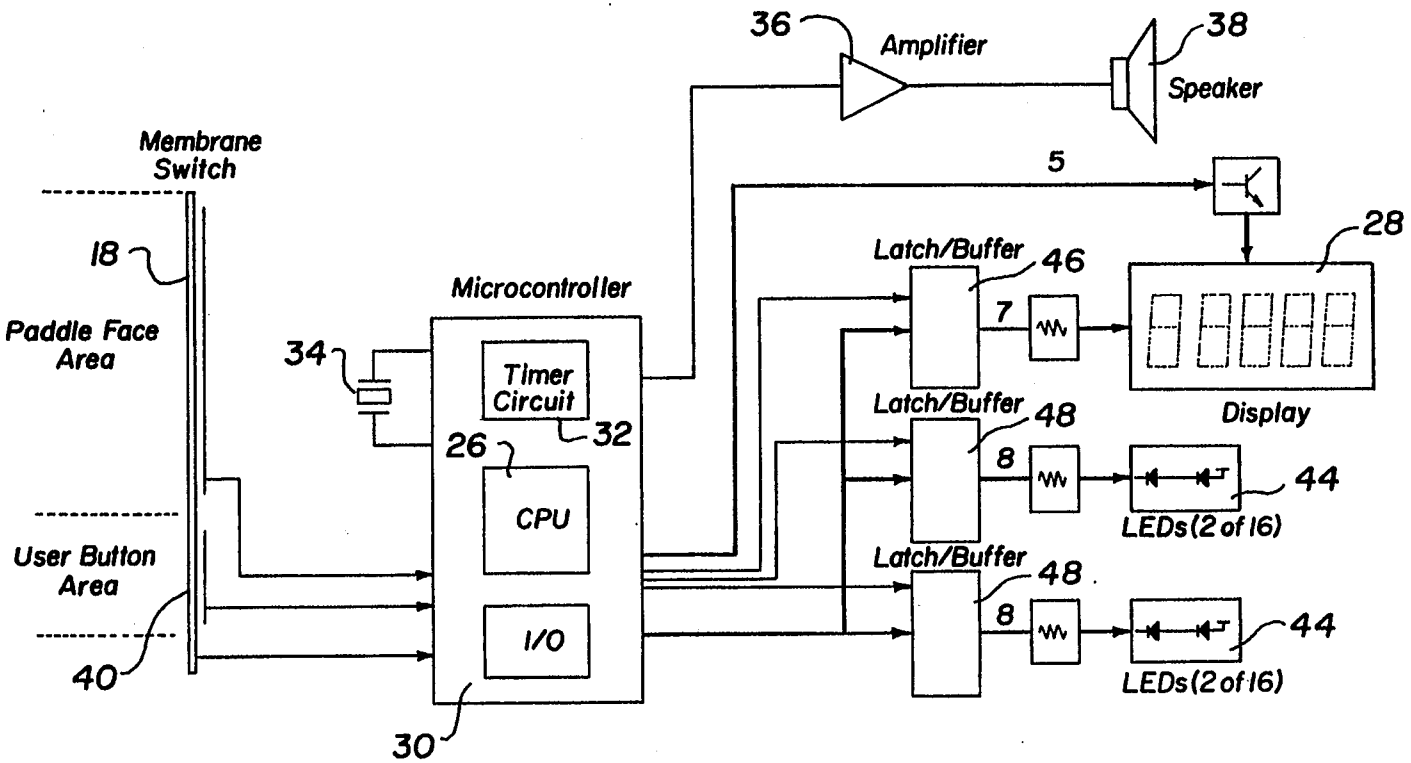
FIG. 4 is a block diagram of the electronics thereof.
Figure 6:
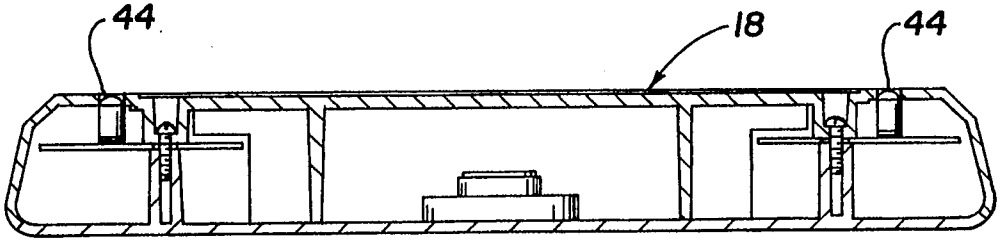
FIG. 6 is a sectional view thereof taken at 6—6 of FIG. 5.
Figure 5:
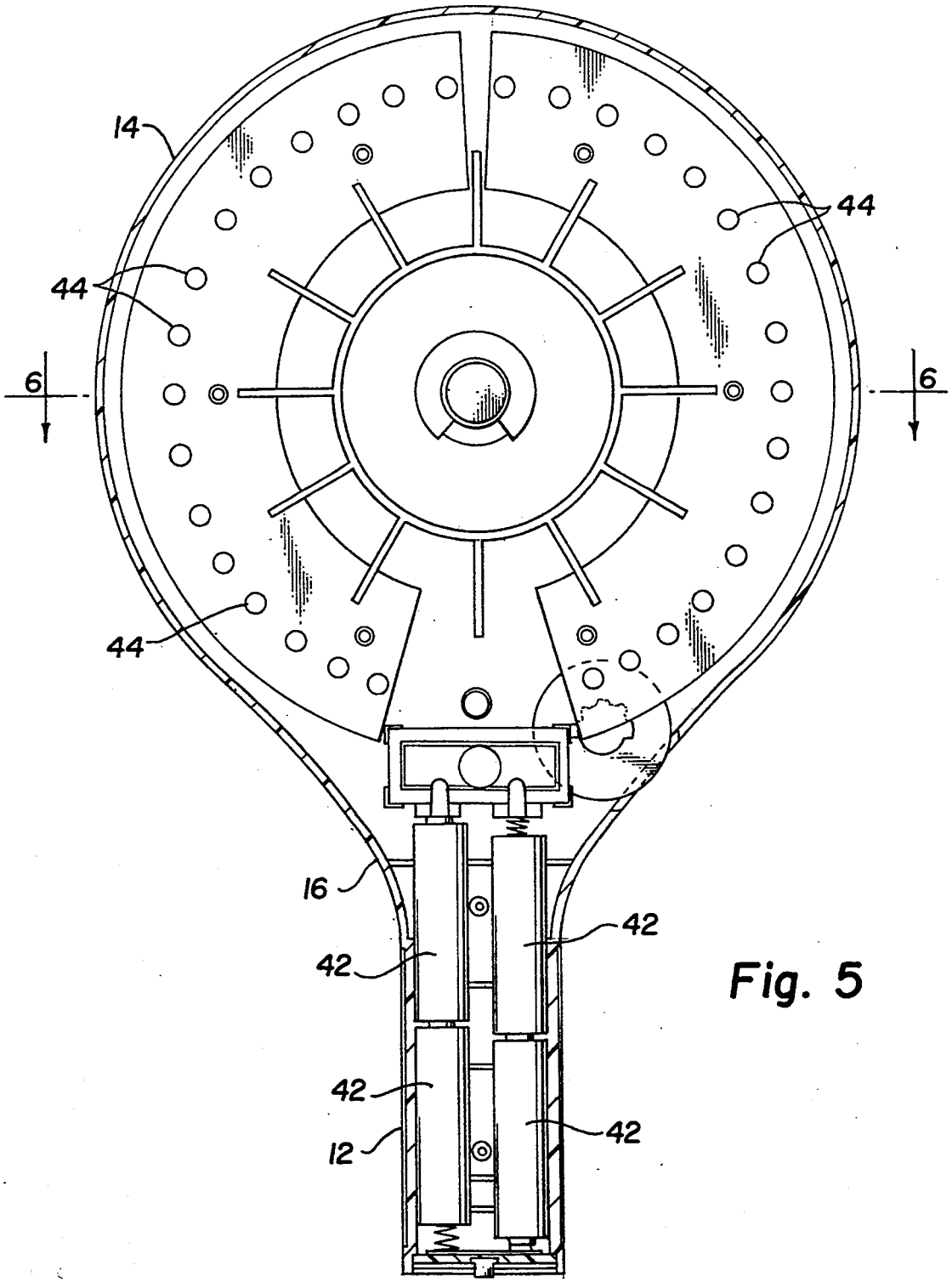
FIG. 5 is a front elevation sectional view thereof.

Referring now to the drawing, and in particular to FIG. 1 and FIG. 2, a paddle according to the present invention for use by a player for hitting a ball or other object is referred to generally by reference numeral 10. The word "paddle" is used here is a broad sense to include paddle in the narrow sense and such items as bats and rackets. Paddle 10 is constructed from a plastic housing which includes a handle 12 for the player to manually hold the paddle and a body 14 attached to handle, forming a neck 16 between the body and the handle. A surface membrane 18 for hitting ball 20 forms at least one face of the paddle. Body 14 of paddle 10 in combination with the at least one hitting surface 18 forms the blade of the paddle. A transducer 22 is coupled to hitting surface 18 for detecting when the hitting surface hits ball 20. In one preferred arrangement surface 18 is the outer face of a pressure sensitive pad which acts as transducer 22.

Referring also to FIGS. 3 through 6, the electronics of paddle 10 is located on a printed circuit board 24. A counter such as forms part of processor 26 is coupled to transducer 22 for counting the number of times that the ball is struck by surface 18, and a display 28 located on or adjacent to neck 16 of the paddle is coupled to processor 26 for indicating the number of hits. In a preferred arrangement, the counter is a processor from a microcontroller 30. An SGS ST6215 is one suitable microcontroller which could be used. In such an arrangement, a number of players can play, entering the number of players into the microcontroller.

A timer circuit 32 of microcontroller 30 is connected to crystal 34 to form a timer circuit which is coupled to transducer 22 and to processor 26 for determining the time elapsed from when the hitting surface hits ball 20. The timer stops the counter when the time elapsed since the most recent hit exceeds a predetermined length of time. The predetermined length of time would be one that would indicate a "miss" of the ball and would be no more than a few seconds.

An audio amplifier 36 is coupled to transducer 22, through microcontroller 30 or otherwise, and to a speaker 38 so that the speaker makes a first predetermined sound whenever the hitting surface hits the object. The speaker emits a second predetermined sound when there is a miss, as indicated by the timer. In an arrangement with multiple players, the speaker emits a third predetermined sound when the number of players is entered or when the number of the current player is changed.

A manual reset 40 is coupled to processor 26. When the manual reset is activated by a player, the counter of processor 26 is reset to zero. For the paddle and ball arrangement, the manual reset is a normal push button located on or adjacent to neck 16 of the paddle and can also be used for input of the number of players to microcontroller 30. Either the start of a new game or a change of players would reset the counter. Pressing push button 40 for a short period of time would change from one player to the next. About one second would be typical. Pressing it for a longer period of time would start a new game. Two to several seconds could be used.

A source of electric power, such as batteries 42, for operation of processor 26, display 28 and amplifier 36 is located inside the handle.

Light emitting diodes 44 are affixed to body 14 near the periphery of hitting surface 18. They are controlled by processor 26 to flash in decorative patterns. The light emitting diodes could, on the other hand, be coordinated to display when a hit is made or when a miss is detected or when some other game event occurs.

Microcontroller 30 remains in a low power state until push button 40 is pressed. The push button is also used to select the mode of operation. Tones are produced by toggling the output of timer circuit 32 at an appropriate rate. Data for display 28 are stored in octal buffer/latch 46, and the light emitting diodes are driven by buffer/latches 48 (not all shown).

Figure 7:
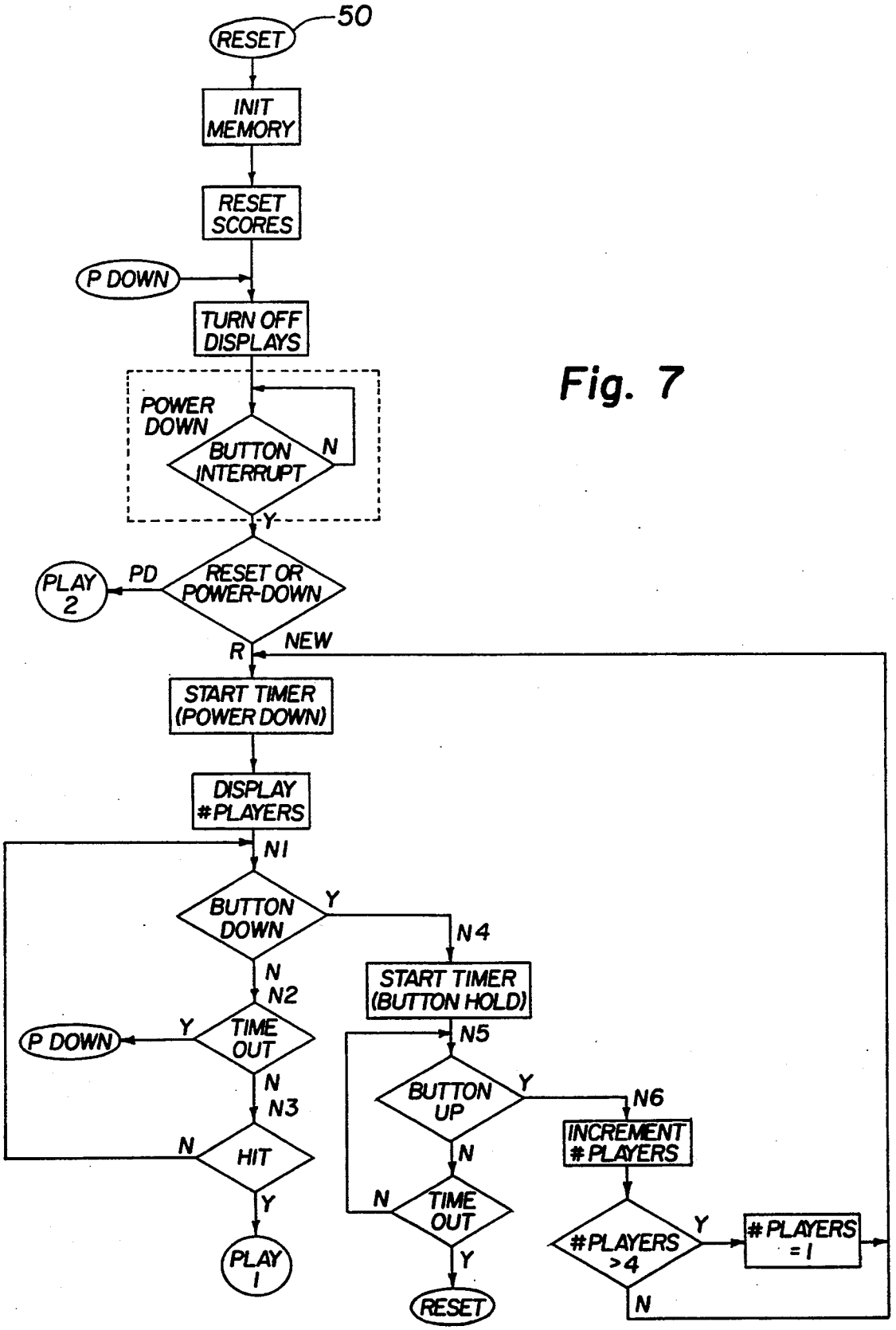
FIG. 7 is a flow diagram representation of a method for initializing the electronics thereof for playing a game according to the present invention.
Figure 8:
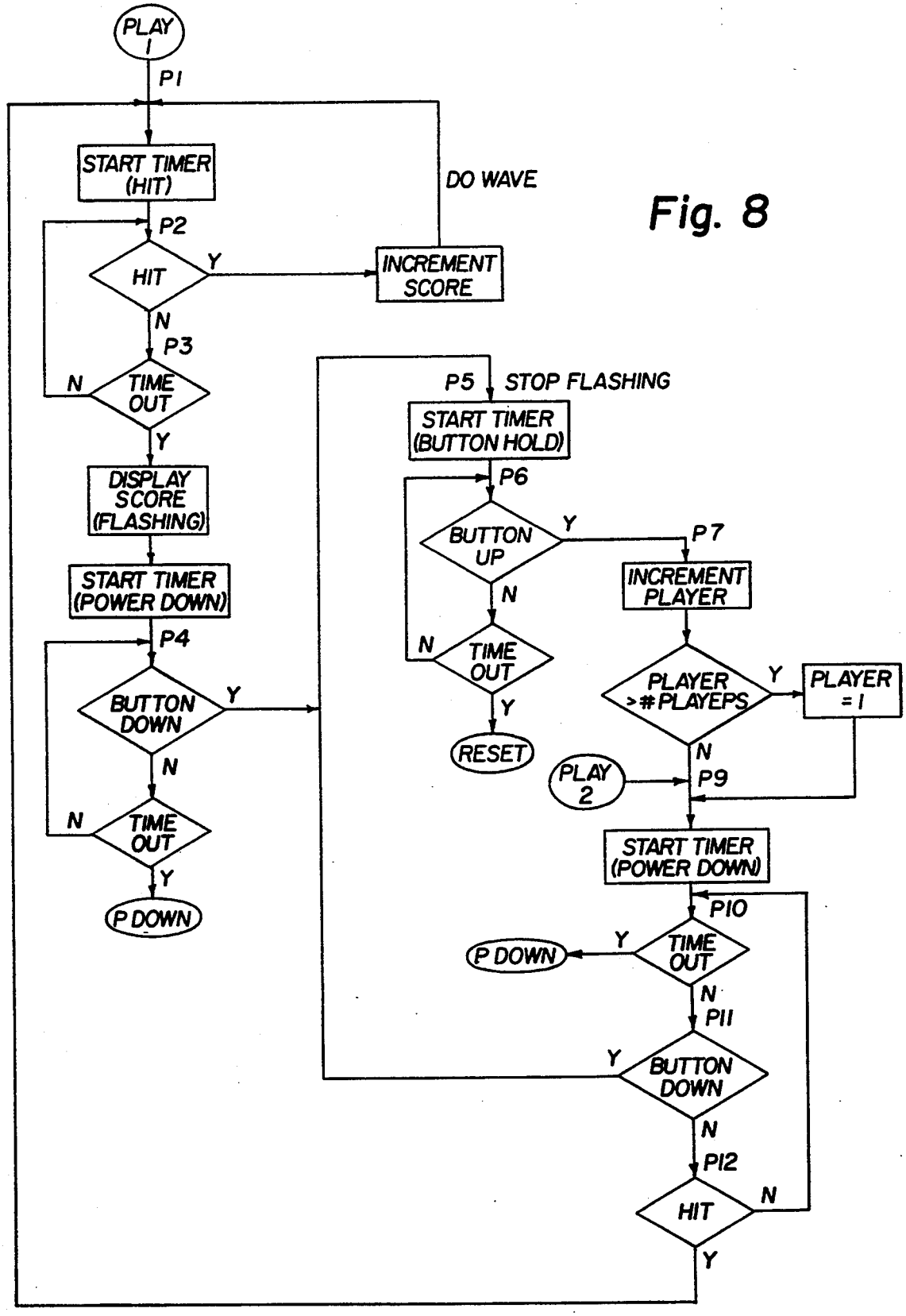
FIG. 8 is a flow diagram representation of a method for the electronics thereof during play of a game according to the present invention.

Referring now to FIG. 7 and FIG. 8, microcontroller 30 enters reset state when push button 40 is held down for more than about two seconds or when the battery power is first applied. The reset routine initializes memory, registers and timer. All ports of the microcontroller are initialized and an interrupt from the push button is enabled. All of the displays are placed in the off state. After the initialization, microcontroller 30 is put into a low power mode. In the low power mode, the oscillator is stopped and the peripheral circuits are disabled.

The microcontroller is brought out of the low power mode by an interrupt generated when push button 40 is pressed. If the power down mode is entered by means of a reset, then a "1" is displayed indicating one player mode after a catchy jingle is played on speaker 38. If the power down mode was entered by means of a timeout due to inactivity, the state when the time out occurred is restored.

After a reset, a user must enter the number of players by repeatedly pressing push button 40 until the desired number of players is indicated in display 28. The displayed number of players flashes during the selection process. When ball 20 first strikes hitting surface 18, play begins with player number one out of the currently displayed number of players. To change the number of players after play has begun, the user must hold down push button 40 to reset the circuit.

In play mode, the time between hits is tested against a predetermined length of time. The player's score incremented for each hit, after the first, that occurs within the timeout period. If the cumulative score is displayed flashing. To continue play, the user must press push button 40 at least once. This stops the score from flashing and advances to the next player. The push button may be pressed repeatedly to view the cumulative score for each player. Play resumes with the currently displayed player when a hit is detected. The scores are cleared only when microcontroller 30 is reset, either by holding down push button 40 or removing the batteries. If the players cumulative score exceeds a predetermined value, then a tune of encouragement is played after each miss.

Sounds are produced to confirm user input. The internal timer circuit is used to toggle the timer output pin at an audio frequency driving amplifier 36 and speaker 38. Short clicks are produced to confirm hits during play. A short beep confirms pressing push button 40. A miss during play is signaled by a double tone and a push button reset by a different double tone.

It is now easy to see that in general, an apparatus for hitting an object includes a surface for hitting the object, a counter, a transducer coupled to the hitting surface and to the counter, for indicating to the counter when the hitting surface hits the object, and a display coupled to the counter for indicating the number of hits or other pertinent data.

From the foregoing it will be seen that this invention is well adapted to attain all of the ends and objectives hereinabove set forth, together with other advantages which are inherent to the apparatus.

It will be understood that certain features and sub combinations are of utility and may be employed without reference to other features and sub combinations.

This is contemplated by and is within the scope of the claims.

As many possible embodiments may be made of the invention without departing from the scope thereof, it is to be understood that all matter herein set forth or shown in the figures of the accompanying drawings is to be interpreted as illustrative and not in a limiting sense.

I claim:

1. An apparatus for hitting an object, comprising in combination:

a surface for hitting the object;

a counter;

a transducer coupled to the hitting surface and to the counter, for indicating to the counter when the hitting surface hits the object;

a display coupled to the counter for indicating the number of hits; and a timer coupled to the transducer and to the counter for determining the time elapsed from when the hitting surface hits the object, wherein the timer stops the counter when the time elapsed since the most recent hit exceeds a predetermined length of time.

2. An apparatus according to claim 1 further comprising:

a speaker; and an amplifier coupled to the transducer and to the speaker for driving the speaker, wherein the speaker makes a sound whenever the hitting surface hits the object.

3. An apparatus according to claim 2 wherein the counter comprises a processor, the apparatus further comprising a manual reset coupled to the processor, wherein when the manual reset is activated, the counter is reset to zero.

4. An apparatus according to claim 1 further comprising a tether connecting the object to the hitting surface.

5. An apparatus for hitting an object, comprising in combination:

a surface for hitting the object;

a timer;

a transducer coupled to the hitting surface and to the timer for indicating to the timer when the hitting surface hits the object; and a display coupled to the timer wherein the timer determines the time elapsed from when the hitting surface hits the object and indicates on the display when the time elapsed since the most recent hit exceeds a predetermined length of time.

6. An apparatus according to claim 5 further comprising:

a speaker; and an amplifier coupled to the transducer and to the speaker for driving the speaker, wherein the speaker makes a sound whenever the hitting surface hits the object.

7. An apparatus according to claim 5 further comprising a tether connecting the object to the hitting surface.

8. A paddle for use by a player for hitting an object, comprising in combination:

a handle for the player to manually hold the paddle;

a surface forming at least one face of the paddle, for hitting the object;

a counter;

a transducer coupled to the hitting surface and to the counter, for indicating to the counter when the hitting surface hits the object;

a display coupled to the counter for indicating the number of hits; and a timer coupled to the transducer and to the counter for determining the time elapsed from when the hitting surface hits the object, wherein the timer stops the counter when the time elapsed since the most recent hit exceeds a predetermined length of time.

9. An paddle according to claim 8 further comprising:

a speaker; and an amplifier coupled to the transducer and to the speaker for driving the speaker, wherein the speaker makes a sound whenever the hitting surface hits the object.

10. An paddle according to claim 9 wherein the counter comprises a processor, the apparatus further comprising a manual reset coupled to the processor, wherein when the manual reset is activated, the counter is reset to zero.

11. A paddle according to claim 10 wherein a source of electric power for operation of the processor, the display and the amplifier is located inside the handle.

12. A paddle according to claim 11 further comprising:

a body attached to handle, forming a neck between the body and the handle, wherein the body in combination with the at least one hitting surface form the blade of the paddle; and lights coupled to the processor and affixed to the body near the periphery of the hitting surface, wherein the lights are powered by the power source and controlled by the processor.

13. A paddle according to claim 12 wherein the display and the manual reset are located on or adjacent to the neck of the paddle.

14. A paddle according to claim 8 further comprising a tether connecting the object to the hitting surface.

15. A paddle for use by a player for hitting an object, comprising in combination:

a handle for the player to manually hold the paddle;

a surface forming at least one face of the paddle, for hitting the object;

a counter;

a transducer coupled to the hitting surface and to the counter, for indicating to the counter when the hitting surface hits the object;

a display coupled to the counter for indicating the number of hits;

a speaker;

an amplifier coupled to the transducer and to the speaker for driving the speaker, wherein the speaker makes a sound whenever the hitting surface hits the object and wherein the counter comprises a processor;

a manual reset coupled to the processor, wherein when the manual reset is activated, the counter is reset to zero, wherein a source of electric power for operation of the processor, the display and the amplifier is located inside the handle;

a body attached to the handle, forming a neck between the body and the handle, wherein the body in combination with the at least one hitting surface form the blade of the paddle; and lights coupled to the processor and affixed to the body near the periphery of the hitting surface, wherein the lights are powered by the power source and controlled by the processor.

16. A paddle according to claim 15 wherein the display and the manual reset are located on the neck of the paddle.

* * * * *